US011486186B2

(12) United States Patent
Razzaboni et al.

(10) Patent No.: US 11,486,186 B2
(45) Date of Patent: Nov. 1, 2022

(54) SYSTEM FOR THE SAFE COUPLING OF A RE-USABLE BAG TO A BANKNOTE HANDLING AND STORING MACHINE

(71) Applicant: CIMA S.p.A., Mirandola (IT)

(72) Inventors: Nicoletta Razzaboni, Mirandola (IT); Vittorio Razzaboni, Mirandola (IT)

(73) Assignee: CIMA S.P.A., Mirandola (IT)

( * ) Notice: Subject to any disclaimer, the term of this patent is extended or adjusted under 35 U.S.C. 154(b) by 362 days.

(21) Appl. No.: 16/851,783

(22) Filed: Apr. 17, 2020

(65) Prior Publication Data

US 2020/0332587 A1 Oct. 22, 2020

(30) Foreign Application Priority Data

Apr. 18, 2019 (IT) ..... 102019000006048

(51) Int. Cl.
*E05G 1/04* (2006.01)
*E05G 1/00* (2006.01)
(Continued)

(52) U.S. Cl.
CPC ..... *E05G 1/04* (2013.01); *E05G 1/005* (2013.01); *E05G 1/10* (2013.01); *E05G 7/001* (2013.01);
(Continued)

(58) Field of Classification Search
CPC .. E05G 1/04; E05G 1/005; E05G 1/10; E05G 7/001; E05G 2700/00; E05G 2700/02;
(Continued)

(56) References Cited

U.S. PATENT DOCUMENTS 3,292,849 A * 12/1966 Ewing ..... E05G 1/005 232/15
3,795,417 A * 3/1974 Cohen ..... G07F 9/06 292/144
(Continued)

FOREIGN PATENT DOCUMENTS

EP 2648165 A1 10/2013

OTHER PUBLICATIONS

IT Search Report dated Nov. 28, 2019 re: Application No. IT 102019000006048, pp. 1-11, citing: US 2001/0054643 A1 and EP 2 648 165 A1.

*Primary Examiner* — Lloyd A Gall
(74) *Attorney, Agent, or Firm* — Cantor Colburn LLP

(57) ABSTRACT

A system for the safe coupling of a re-usable bag to a banknote handling and storing machine includes a bag container, having a rigid upper port and a flexible bag permanently fixed to the rigid port, a lid, designed to be inserted onto the rigid port for closing the bag container when the filling operations are terminated, and a bag-holding frame. The bag-holding frame is suitable for being stably fixed to a safe structure of the machine for supporting and hooking the bag container when placed inside the machine to be filled with the banknotes. The system is provided with first coupling and hooking electro-mechanical components between the bag container and the bag-holding frame and with second coupling and hooking electro-mechanical components between the lid and the bag container. The first and second coupling and hooking electro-mechanical components are interconnected with a control unit to enable the respective functions.

15 Claims, 5 Drawing Sheets

(51) Int. Cl.

| | |
|---|---|
| ***E05G 7/00*** | (2006.01) |
| ***G07D 11/00*** | (2019.01) |
| ***G07D 11/125*** | (2019.01) |
| ***E05G 1/10*** | (2006.01) |

(52) U.S. Cl.
CPC ..... *G07D 11/0096* (2013.01); *G07D 11/125* (2019.01)

(58) Field of Classification Search
CPC ..... E05G 1/026; E05G 1/024; G07D 11/0096; G07D 11/125; G07D 11/14; G07D 11/225; G07D 11/12; G07D 11/0087
USPC ..... 109/24.1, 47, 66; 235/379; 194/350; 232/15, 16; 902/9
See application file for complete search history.

(56) References Cited

U.S. PATENT DOCUMENTS

| | | | | |
|---|---|---|---|---|
| 4,529,118 | A * | 7/1985 | Granzow | G07D 11/125 109/43 |
| 5,715,923 | A * | 2/1998 | Dekker | G07F 7/04 232/15 |
| 5,850,966 | A * | 12/1998 | Siler | G07F 9/06 109/46 |
| 5,873,446 | A * | 2/1999 | Wei | G07F 9/06 232/16 |
| 6,042,001 | A * | 3/2000 | Siler | G07F 9/06 109/46 |
| 2001/0054643 | A1 | 12/2001 | Siemens | |
| 2007/0145064 | A1* | 6/2007 | Clauser | G07D 11/12 220/212.5 |
| 2011/0186622 | A1* | 8/2011 | Nikon | G07F 9/06 232/15 |
| 2022/0186546 | A1* | 6/2022 | Razzaboni | B65B 67/12 |

* cited by examiner

SYSTEM FOR THE SAFE COUPLING OF A RE-USABLE BAG TO A BANKNOTE HANDLING AND STORING MACHINE

CROSS-REFERENCE TO RELATED APPLICATIONS

This application is related to, and claims the benefit of, Italian patent application No. 102019000006048, filed on Apr. 18, 2019, the contents of which are hereby incorporated by reference in their entirety.

TECHNICAL FIELD

The present disclosure relates to a system for the safe coupling of a re-usable bag, intended to be filled with banknotes or other paper currency, to a banknote handling and storing machine.

The disclosure also relates to a method for coupling and removing such a bag to/from the machine.

BACKGROUND

Banknote handling and storing machines are normally provided with a safe in which the banknotes (at least those that are not optionally intended to be directly dispensed by the machine itself, if the machine provides for this functionality) are accumulated waiting to be removed and taken to suitable currency deposit stores, or used to fill other cash dispenser machines.

In order to accumulate banknotes in the safe it is possible to use rigid containers (boxes) or flexible bag-type containers. In turn, bag-type containers may be of the single-use type, which are sealed (or in any case irreversibly closed) once filled, before being extracted from the machine, or of the reusable type. The latter are provided with a reversible closure, typically a lid that must be applied to the mouth of the bag to enable the release of the bag itself from the frame of the safe.

In the prior art, the coupling systems of reusable bags to the machine essentially comprise three components:

- a bag-holding frame, fixed to the safe of the banknote handling and storing machine, which has the function of supporting the bag and keeping it hooked;
- the bag container, comprised of a rigid port (or frame), to which the flexible bag is permanently fixed;
- a lid (normally comprised of a rigid element), intended to close the port of the bag container when the filling operations are terminated, which also has the function of enabling the release of the bag container from the safe (once hooked to the rigid port).

Both the hooking of the bag to the bag-holding frame, and the hooking of the lid to the rigid port of the bag container are currently done through purely mechanical couplings.

It is clear how this can lead to serious safety problems both with regard to the possibility of removing the bag container inappropriately from the safe, and with regard to the possibility of tampering with the lid after the extraction of the bag container from the safe.

In particular, in order to try to at least partially limit the possibility of tampering after the removal of the container from the machine, it is common for the operator in charge of transporting valuables to apply a safety seal to the bag after having inserted the lid onto the rigid port.

Typically, such a safety seal consists of a plastic strap inserted in respective slots present on the edge of the lid and of the rigid port of the bag container. However, there can be no guarantee against possible fraudulent actions against the container, for example breaking the strap and then replacing it with a new one after having tampered with the content of the bag.

SUMMARY

The general purpose of the present disclosure is to avoid the aforementioned drawbacks by providing a system for the safe coupling of a re-usable bag to a banknote handling and storing machine, which allows an increase in the security level both in relation to authorisation to remove the bag from the machine, and in relation to possible tampering of the bag during the subsequent transportation steps.

A further purpose of the disclosure is to ensure that the bag can be removed from the machine only if the correct lid intended to be associated, by the authorised operator, to that specific bag is applied thereto.

In view of such purposes it has been thought of to make, according to the disclosure, a system for the safe coupling of a re-usable bag to a banknote handling and storing machine, comprising:

- a bag container, comprised of a rigid upper port and of a flexible bag permanently fixed to said rigid port;
- a lid, designed to be inserted onto the rigid port for closing the bag container when the filling operations are terminated;
- a bag-holding frame, suitable for being stably fixed to a safe structure of the machine, for supporting and hooking the bag container when placed inside the machine to be filled with the banknotes;

characterized in that it comprises first coupling and hooking electro-mechanical means between the bag container and the bag-holding frame and second coupling and hooking electro-mechanical means between the lid and the bag container, said first coupling and hooking electro-mechanical means between the bag container and the bag-holding frame comprising a first electro-actuated lock provided on the bag-holding frame and a blocking element provided on the rigid port of the bag container in correspondence of said first electro-actuated lock to engage and block into the same when the bag container is correctly coupled to the bag-holding frame, with a micro-switch provided within said first electro-actuated lock to detect the correct blocking of the rigid port in the bag-holding frame and to send to a control unit a signal of correct blocking of the bag container on the bag-holding frame, said first coupling and hooking electro-mechanical means between the bag container and the bag-holding frame further comprising a first electric connector provided on the bag-holding frame and a second electric connector provided on the rigid port of the bag container in correspondence of said first electric connector to realize the electric connection between the bag container, the bag-holding frame and the control unit when the bag container is positioned on the bag-holding frame, said first coupling and hooking electro-mechanical means between the bag container and the bag-holding frame further comprising a position sensor, provided on the bag-holding frame, to detect the presence of the bag container in the correct position on the bag-holding frame and to send to the control unit a signal of the presence of the bag container on the bag-holding frame, said second coupling and hooking electro-mechanical means between the lid and the bag container comprising a second lock provided on the rigid port of the bag container and a hooking element provided on the lid in correspondence of said second lock to engage and block into the same when the lid is correctly inserted on the rigid port in a closure position of the bag container, with a microswitch provided within said second lock to detect the correct insertion of the lid in the rigid port of the bag container and to send to the control unit a signal of correct insertion of the lid through the electric connectors between the bag container and the bag-holding frame.

According to the disclosure, a method for coupling and removal of a bag container from a banknote handling and storing machine has also been made, comprising, for the insertion of the bag container into the machine, the steps of:

applying a safety seal on the closure door of said second lock provided on the rigid port of the bag container, thus preventing the access to the lid release button;

introducing the bag container inside the machine, inserting its upper rigid port into guides of the bag-holding frame until engagement of the blocking element in said first electro-actuated lock provided on the bag-holding frame, thus realizing an electric connection between the electric connectors respectively provided on the bag-holding frame and on the bag container and sending to the control unit a signal of presence and correct blocking of the bag container on the bag-holding frame;

and for removal of the bag container from the machine, the steps of:

inserting the closure lid onto the upper rigid port of the bag container along guides of said rigid port until engagement of the blocking element in said second lock provided on the rigid port of the bag container, thus sending to the control unit a signal of correct insertion of the lid through the electric connectors between the bag container and the bag-holding frame and obtaining from the control unit an opening command for said first electro-actuated lock to release the bag container from the bag-holding frame;

extracting the bag container from the machine.

BRIEF DESCRIPTION OF THE DRAWINGS

In order to make the explanation of the innovative principles of the present disclosure and the advantages thereof with respect to the prior art clearer, a possible embodiment applying such principles will be described hereinafter, with the help of the attached drawings. In the drawings.

DETAILED DESCRIPTION OF THE DRAWINGS

Figure 1:
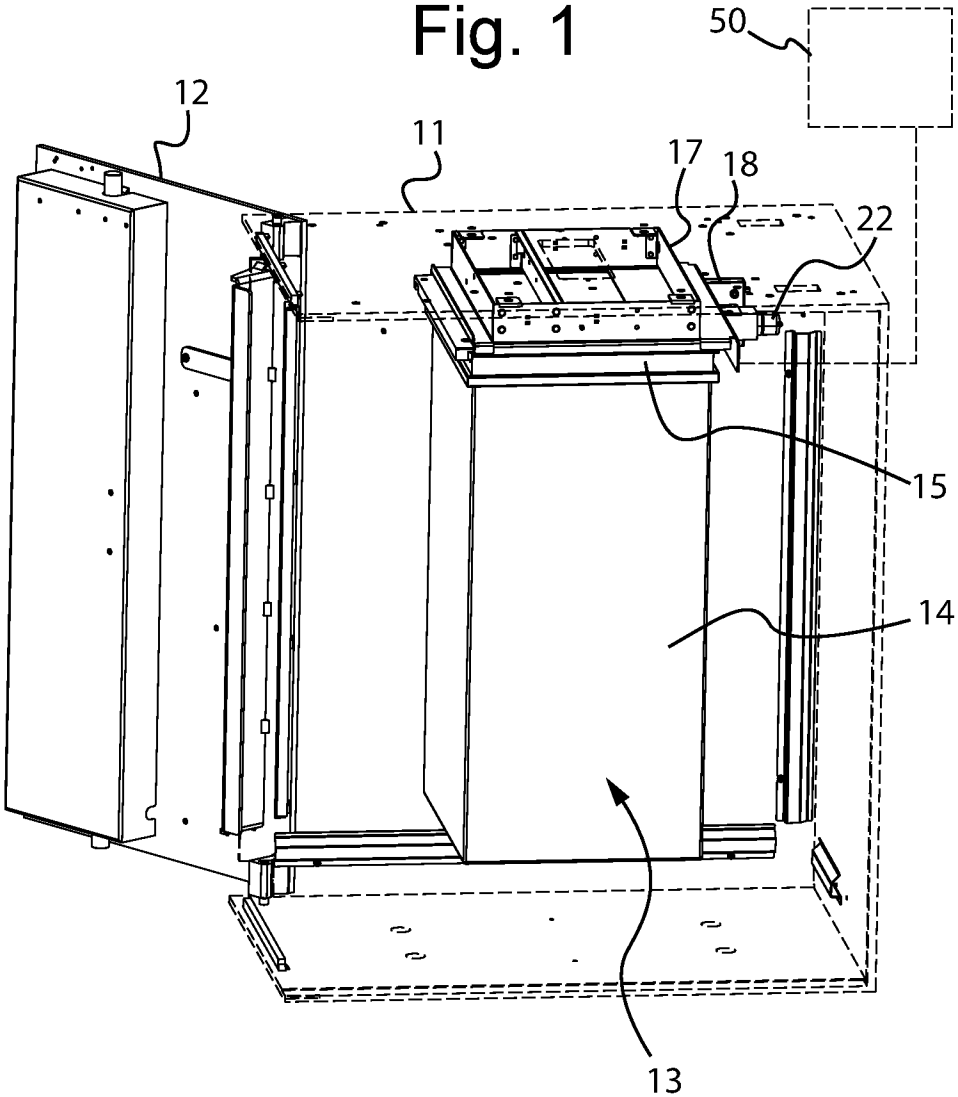
FIG. 1 represents a general view of a part (specifically the safe) of a banknote handling and storing machine, with a bag container according to the disclosure inserted.

With reference to the figures, FIG. 1 shows a part of a banknote handling and storing machine, more specifically the safe 11 (represented "transparently" to make the inside thereof visible) with its door 12 openable, through known locking means, so as to be able to access the inside of the safe and, in particular, insert and extract the bag container 13.

The rest of the machine is not represented here, since it can be any type of banknote handling and storing machine normally present in various environments, commercial, banking, etc., for example machines capable both of receiving and of dispensing banknotes or other paper documents, or machines adapted for only receiving and storing banknotes.

The bag container 13 inside the machine is comprised essentially of two main components, i.e. a flexible bag 14, adapted for being filled with the banknotes coming from the handling and conveying devices present inside the machine, and a rigid upper port 15 of generically rectangular shape, which acts as permanent fixing and support frame of the bag 14.

The frame or rigid port 15 is also intended to cooperate with a lid 16 (visible in FIGS. 2, 3 and 4) to obtain the closure of the bag container 13, as will be explained in greater detail hereinafter.

The bag container 13 is of the re-usable type, i.e. a closable and re-openable bag, so as to be able to be used many times, repeating the cycle of insertion in empty condition into the safe, filling with banknotes by the machine, closure with the lid 16, extraction from the machine and transfer towards a place of storage or reuse of the banknotes.

The bag 14 is made of flexible material, for example 'canvas' fabric, so as to be light, as well as sufficiently strong, and foldable to minimise the space occupied when it is not used.

FIG. 1 also shows a bag-holding frame 17, stably fixed to the safe structure 11, which has the function of supporting the bag container 13 and keeping it hooked when placed inside the banknote handling and storing machine. Advantageously, the bag-holding frame 17 has a perimetric configuration substantially corresponding to that of the rigid port 15 of the bag container 13, so that the two elements (frame 17 and rigid port 15) can jointly define a passage for the introduction of banknotes into the flexible bag 14.

Figure 4:
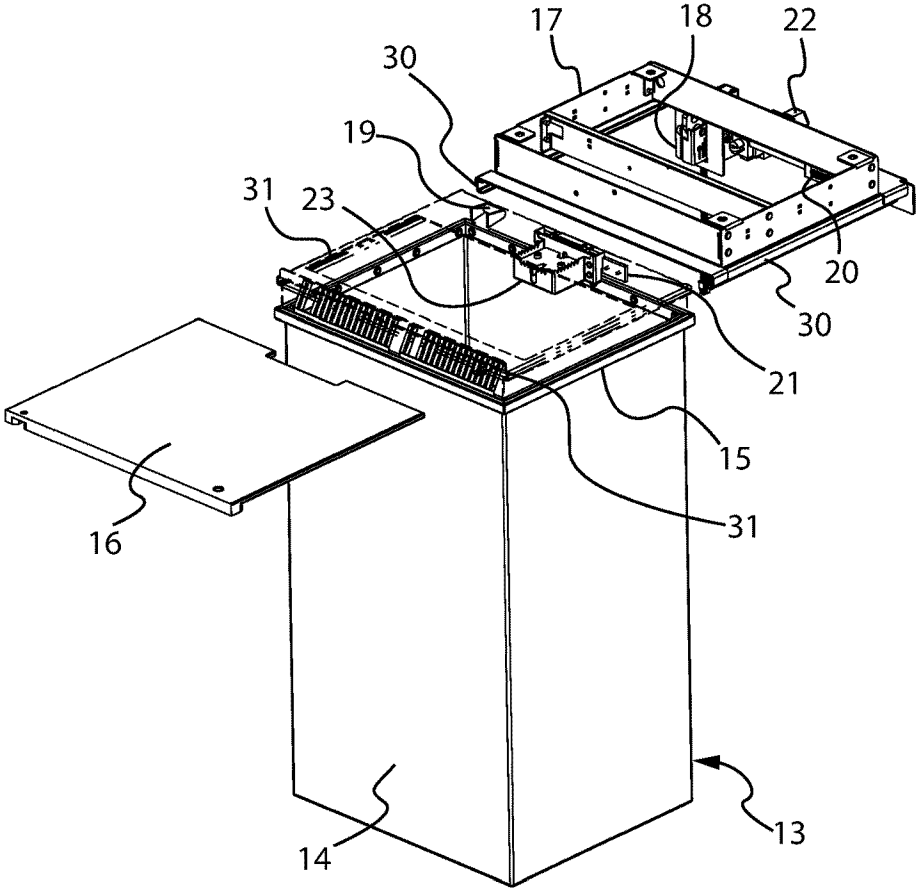
FIG. 4 is a view analogous to that of FIG. 3, but in which the upper part of the mouth of the bag container is represented "transparently", to make the hooking devices with the bag-holding frame and with the closure lid of the bag container visible.
Figure 3:
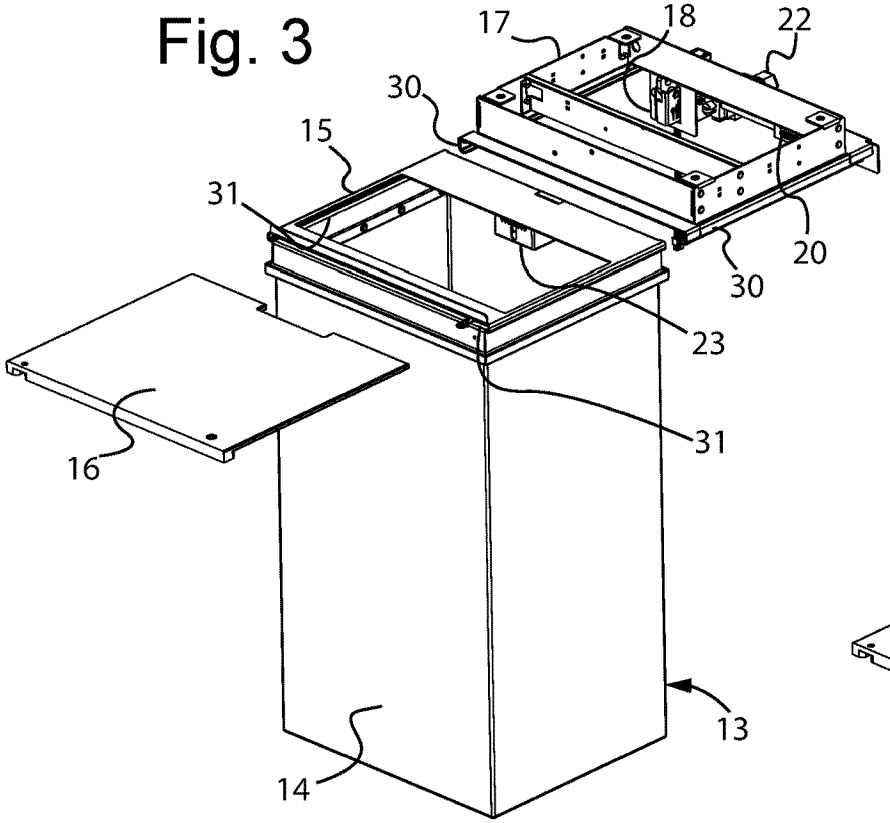
FIG. 3 represents an exploded view of the three components of the coupling system of the bag to the machine according to the disclosure.
Figure 6:
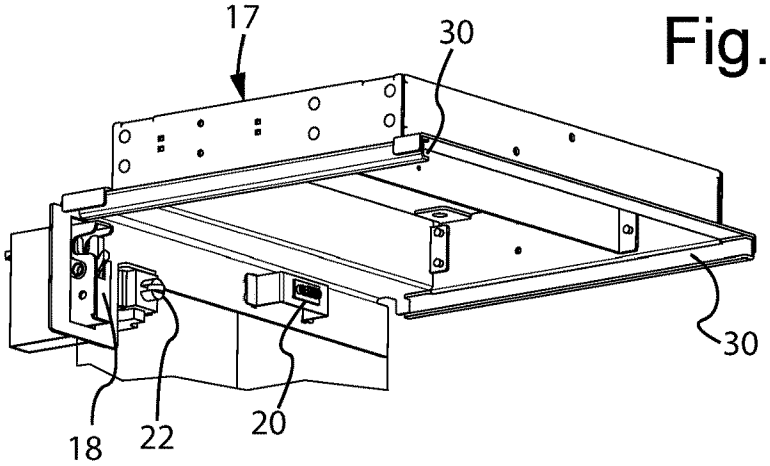
FIG. 6 shows the bag-holding frame seen from below.
Figure 8:
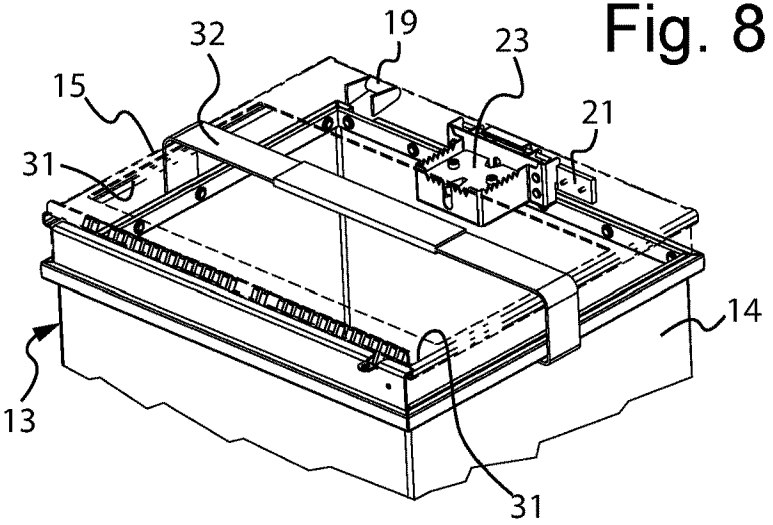
FIG. 8 shows, from the front, the upper portion of the bag container, with some parts of the rigid port removed to make the hooking devices with the closure lid visible.
Figure 5:
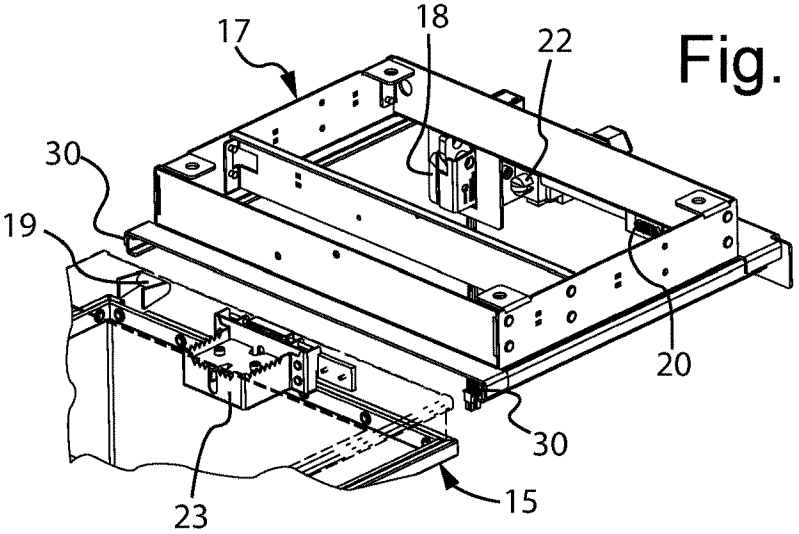
FIG. 5 represents an enlarged portion of FIG. 4, which shows the bag-holding frame in greater detail.
Figure 7:
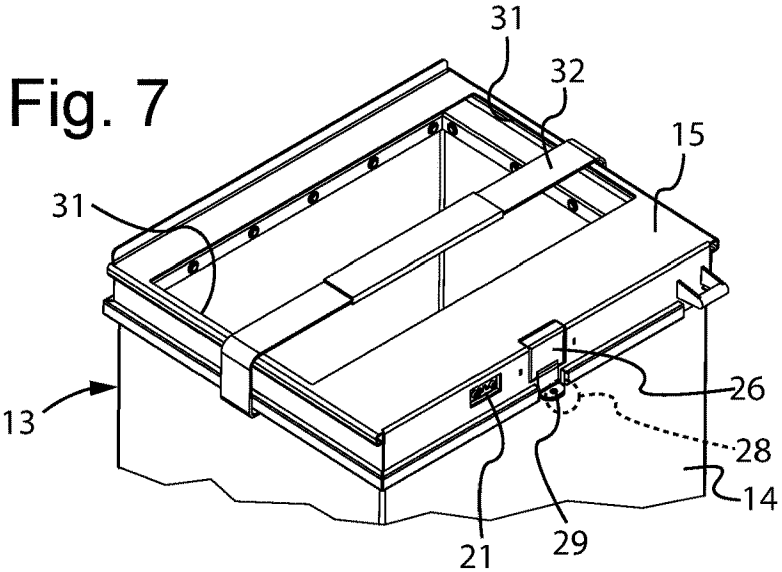
FIG. 7 shows, from the rear, the upper portion of the bag container, with the rigid port intended for fixing onto the bag-holding frame.

The coupling system of the bag container 13 to the machine according to the disclosure essentially comprises three components, clearly visible in separated condition from one another in FIGS. 3 and 4:

the bag container 13, comprised of the rigid upper port 15 and of the flexible bag 14 permanently fixed to the aforementioned rigid port;

the lid 16, designed to be inserted onto the rigid port 15 for closing the bag container 13 when the filling operations are terminated;

the bag-holding frame 17, adapted for being stably fixed to the safe structure, which has the function of supporting the bag container 13 and keeping it hooked when placed inside the machine to be filled with the banknotes.

According to the disclosure, the system for coupling the bag container 13 to the machine provides for first coupling and hooking electro-mechanical means between the bag container 13 and the bag-holding frame 17 and second coupling and hooking electro-mechanical means between the lid 16 and the bag container 13.

In particular, with reference to FIGS. 5-9, said first coupling and hooking electro-mechanical means between the bag container 13 and the bag-holding frame 17 comprise a first electro-actuated lock 18 advantageously arranged on the rear portion of the bag-holding frame 17 and faced toward the front part thereof.

The terms "front" and "rear" here are meant to respectively indicate a part (of the bag, of the lid or of the bag-holding frame) closest to the access opening from the outside to the safe (at the door 12 visible in FIG. 1) and a part farthest from said opening.

Said first coupling and hooking electro-mechanical means between the bag container 13 and the bag-holding frame 17 also comprise a blocking element 19 (advantageously in the form of a cylindrical pin) arranged on the rear portion of the rigid upper port 15 of the bag container 13 and projecting rearward therefrom in correspondence of said first electro-actuated lock 18 to engage and lock in the latter when the bag container 13 is correctly coupled to the bag-holding frame 17 inside the safe 11 in the position illustrated in FIG. 1.

Of course, the blocking element 19 may also be made with a shape different from a cylindrical pin, depending on the type and on the configuration of the lock 18 used in the specific case.

Said first electro-actuated lock 18 is advantageously internally provided with a micro-switch (not visible in the attached drawings) that detects the correct blocking of the rigid upper port 15 in the bag-holding frame 17 and sends a signal of correct blocking of the bag container 13 on the bag-holding frame 17 ("bag inserted" signal) to a control unit 50 (schematically represented in FIG. 1).

Said first coupling and hooking electro-mechanical means between the bag container 13 and the bag-holding frame 17 also comprise a first electric connector 20 advantageously arranged on the rear portion of the bag-holding frame 17, faced toward the front part thereof, and a second electric connector 21 arranged on the rear portion of the rigid upper port 15 of the bag container 13 in correspondence of said first electric connector 20 to make an electric connection between the bag container 13, the bag-holding frame 17 and the control unit 50 when the bag container 13 is in position on the bag-holding frame 17.

Said first coupling and hooking electro-mechanical means between the bag container 13 and the bag-holding frame 17 also comprise a position sensor 22 advantageously arranged on the rear portion of the bag-holding frame 17, faced toward the front part thereof, and adapted for detecting the presence of the bag container 13 in correct position on the bag-holding frame 17 and sending a signal of correct positioning of the bag container 13 on the bag-holding frame 17 ("bag presence" signal) to the control unit 50.

The second coupling and hooking electro-mechanical means between the lid 16 and the bag container 13 comprise a second lock 23 advantageously arranged on the rear portion of the rigid upper port 15 of the bag container 13 and faced toward the front part thereof.

Figure 2:
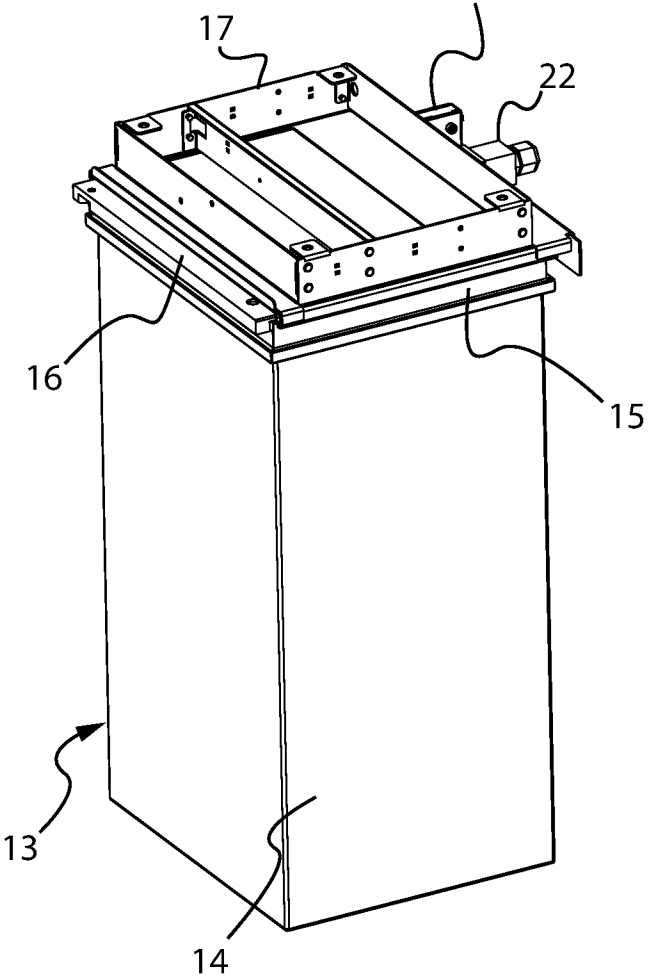
FIG. 2 shows the bag container fixed to the bag-holding frame and closed with the lid, with the rest of the machine not reproduced for greater graphical clarity.

Said second coupling and hooking electro-mechanical means between the lid 16 and the bag container 13 also comprise a hooking element 24 (visible in FIG. 9) arranged on the rear portion of the lid 16 and projecting downwardly therefrom in correspondence of said second lock 23 to engage and block in the latter when the lid 16 is correctly inserted on the rigid port 15 in closure position of the bag container 13 as illustrated in FIG. 2.

Said second lock 23 is advantageously internally provided with a micro-switch (not visible in the attached drawings) that detects the correct insertion of the lid 16 in the rigid upper port 15 of the bag container 13 and sends a signal of correct insertion of the lid through the electric connection 20, 21 between the bag container 13 and the bag-holding frame 17 ("lid inserted" signal) to the control unit 50.

In the embodiment illustrated here, said second lock 23 is also provided with a release button 25 (visible in FIG. 10) for releasing the lid 16 once the bag container 13 has been transferred to destination by the authorised operator.

Figure 10:
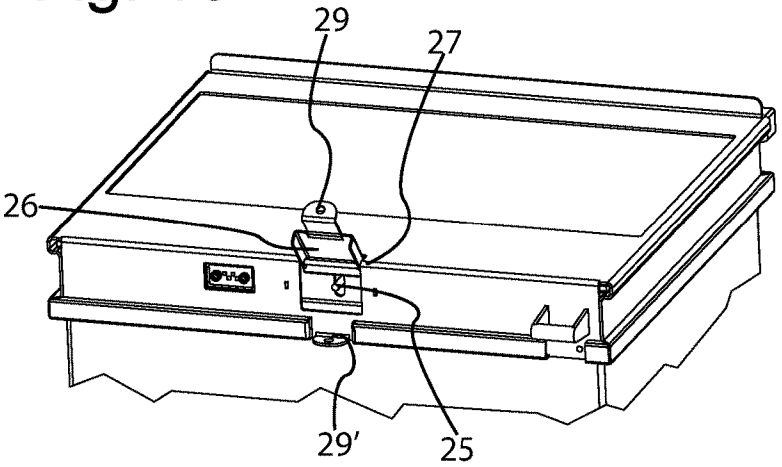
FIG. 10 shows a detail of the release means of the lid from the bag container.

A door 26 is advantageously arranged on the rigid port 15 of the bag container 13, at the release button 25, to be movable between a closed (lowered) position preventing the access to the release button 25 (position shown, for example, in FIG. 7) and an open (raised) position, of accessibility to said release button 25 (illustrated in FIG. 10).

In the illustrated embodiment, the door 26 is pivotable about a horizontal axis 27 to alternately take up said closed (lowered) and open (raised) positions.

Of course, the mobility of the door 26 between the closed position and the open position may also be obtained through vertical translation, or other suitable kinematic motion, instead of through rotation.

The door 26 is normally kept in closed position during the filling and transportation operations of the container, advantageously through a safety seal 28 (shown schematically in FIG. 7) able to be inserted through suitable slots 29, 29' respectively present on the movable door and on the fixed portion of the rigid port 15 of the bag container 13.

The insertion operation of the bag container 13 into the safe 11 and the removal operation of the same container from the safe, at the end of the filling thereof with banknotes coming from the machine, will now be described.

Insertion of the Bag into the Safe.

For the insertion of the bag container 13 into the safe 11 it is firstly necessary to apply the safety seal 28 to the closure door 26 of the lock 23 arranged on the rear portion of the rigid port 15 of the bag container 13, so as to prevent the opening of said door and, therefore, the accessibility to the release button 25 of the lid 16 present in the lock itself.

Figure 12:
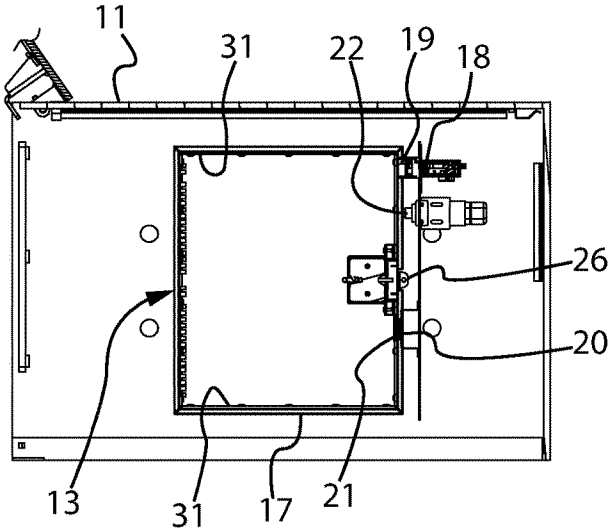
FIG. 12 schematically illustrates the final step of the introduction of the bag container into the safe, correctly fixed to the bag-holding frame.
Figure 9:
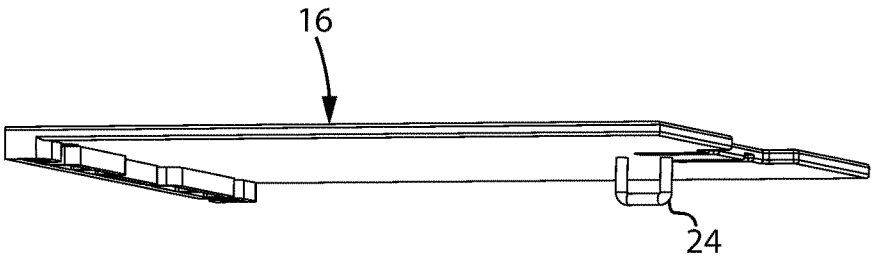
FIG. 9 represents a view from below of the closure lid of the bag container.
Figure 11:
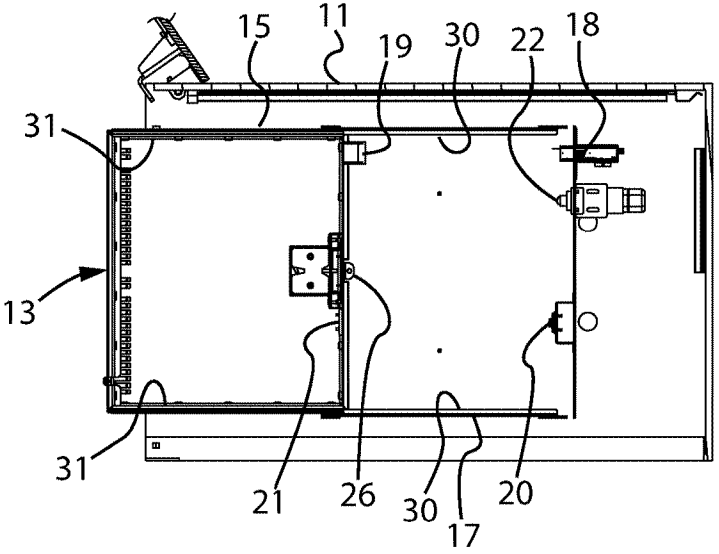
FIG. 11 schematically illustrates the start of the introduction step of the bag container into the safe.

After this, starting from the situation illustrated in FIG. 11, the bag container 13 may be introduced inside the safe 11, inserting the rigid upper port 15 thereof into the inner guides 30 of the bag-holding frame 17 until the engagement of the blocking element 19 in the electro-actuated lock 18 arranged on the rear portion of the bag-holding frame 17 (FIG. 12).

The check of the presence and of the successful blocking of the bag container 13 on the bag-holding frame 17 is signalled to the control unit 50 by the position sensor 22 (which sends the "bag presence" signal) and by the microswitch present in the lock 18 (which detects when the lock itself closes by the passage of the blocking pin 19 and sends the "bag inserted" signal). The control unit 50, once this information has been received, is programmed to no longer allow the release of the bag container 13 from the bag-holding frame 17 until it has received a "lid inserted" signal.

In this situation of bag container 13 correctly blocked on the bag-holding frame 17, the electrical contact between the electrical connections 20, 21 respectively arranged on the bag-holding frame and on the bag container is also obtained.

Removal of the Bag from the Safe.

Figure 13:
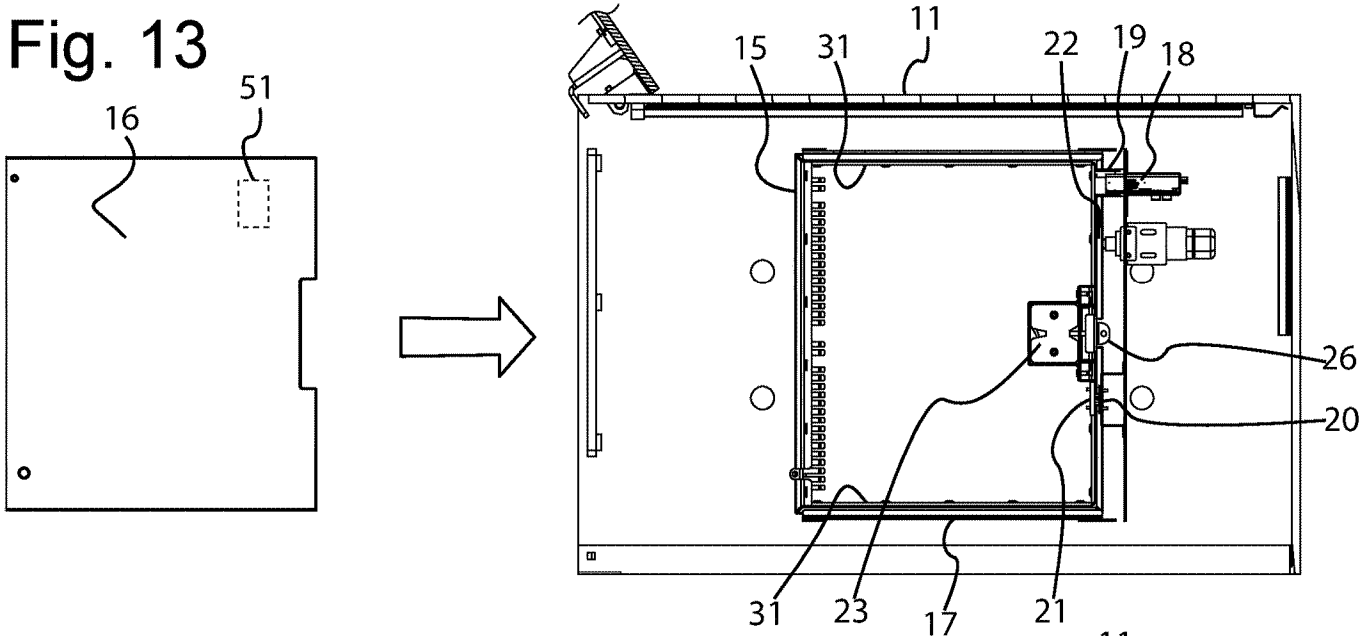
FIG. 13 schematically illustrates the start of the insertion step of the closure lid on the bag container, before the removal of the latter from the safe.
Figure 14:
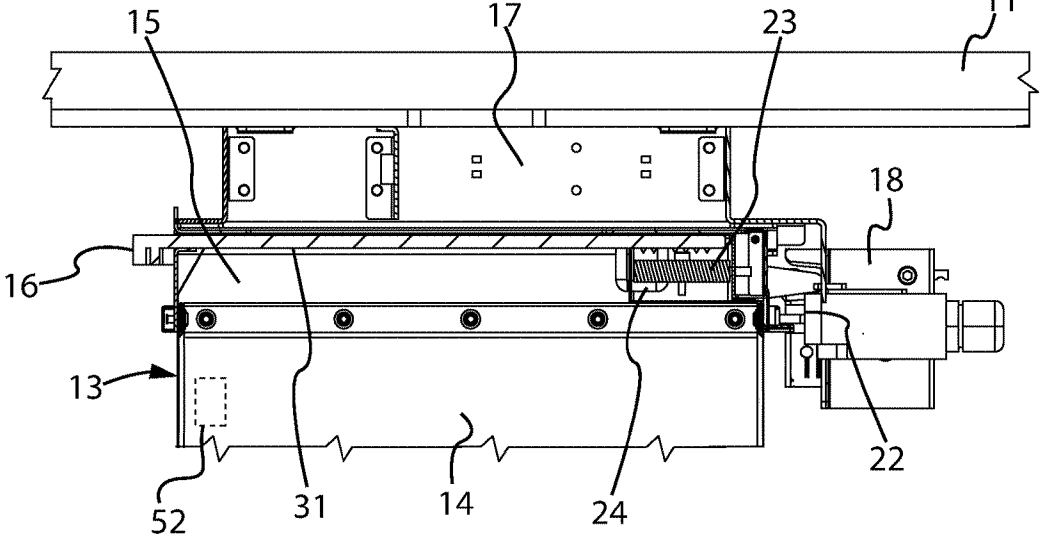
FIG. 14 schematically illustrates the final step of the application of the closure lid on the bag container, with the latter ready for extraction from the safe.

Before being able to remove the bag container 13 from the safe 11, it is necessary (starting from the situation illustrated in FIG. 13) to insert the closure lid 16 on the rigid port 15 of the bag container 13 along the suitable inner guides 31 of the rigid port 15 until the engagement of the blocking element 24 in the lock 23 arranged on the rear portion of the rigid upper port 15 of the bag container 13 (FIG. 14).

The check of the correct insertion of the lid 16 in the rigid upper port 15 of the bag container 13 is signalled to the control unit 50 by the micro-switch present in the lock 23, which detects when the lock itself closes by the passage of the blocking element 24 and sends the "lid inserted" signal to the control unit 50 through the electric connection 20, 21 between the bag container 13 and the bag-holding frame 17.

Once the "lid inserted" signal has been received, the control unit 50 may send an opening control to the electro-actuated lock 18, which by opening will release the bag container 13.

At this point, it is possible to extract the bag container 13 from the safe 11 and transfer it, by an operator in charge of the transportation of valuables, to a banknote storage or reuse location.

Once the container has been brought to a secure location, the safety seal 28 can be removed, so as to open the closure door 26 of the lock 23, by lifting it, to release the lid 16 through the release button 25, which is now accessible.

At this point it is clear how, with the system for the safe coupling of a re-usable bag to a banknote handling and storing machine according to the disclosure, the predetermined purposes have been accomplished.

Indeed, the blocking of the bag container to the bag-holding frame takes place thanks to the electro-actuated lock 18, which does not release the bag until it receives the "lid inserted" information from the control unit, which in turn may be provided only if previously the same control unit has received the "bag presence" and "bag inserted" signals, respectively from the micro-switch present in the lock 18 and from the position sensor 22.

Basically, the aforementioned coupling and hooking electro-mechanical means between the bag container and the bag-holding frame and between the lid and the bag container are interconnected with the control unit to enable the respective blocking and releasing functions.

Of course, the above description of an embodiment applying the innovative principles of the present disclosure is given only as an example of such innovative principles.

For example, the closure lid 16 of the bag container 13 may be provided with a radiofrequency identification device (RFID tag) 51, as schematically shown in FIG. 13, to make it possible to verify the authenticity of the lid inserted on the container.

The bag container 13, in turn, may also be provided with a radiofrequency identification device (RFID tag) 52.

In particular, it is possible to provide that each bag container 13 is associated with only one closure lid 16, provided with its own identification code. When the bag container 13 (in turn provided with its own identification code) is inserted in the safe, this code is communicated to the control unit 50. Then, when at the end of the filling of the container the lid 16 is inserted, the control unit detects the identification code of the latter and, if it is the one associated to the specific container 13, the release of the electro-actuated lock 18 and, therefore, the extraction of the bag container 13 can be activated.

In order to increase the anti-tampering security of the system, the lock 23 for blocking the lid could also be of the electro-actuated type, like the lock 18 for blocking the bag container on the bag-holding frame, connected to a suitable electronic control to obtain the release of the lid 16 without needing the manual release button 25, the closure door 26 and the safety seal 28, which would not thus in this case be necessary.

Finally, the bag container 13 may also advantageously comprise a handle 32 (shown as an example only in FIGS. 7 and 8) for easy transportation of the bag once removed from the machine.

The invention claimed is:

1. A system for the safe coupling of a re-usable bag to a banknote handling and storing machine, the system comprising:

a bag container comprising a rigid port and a flexible bag permanently fixed to said rigid port;

a lid configured to be inserted onto the rigid port for closing the bag container when filling operations are terminated;

a bag-holding frame configured for being stably fixed to a safe structure of the machine, for supporting and hooking the bag container when placed inside the machine to be filled with banknotes;

wherein the system comprises first coupling and hooking electro-mechanical means disposed between the bag container and the bag-holding frame and second coupling and hooking electro-mechanical means disposed between the lid and the bag container;

said first coupling and hooking electro-mechanical means comprising a first electro-actuated lock provided on the bag-holding frame and a blocking element provided on the rigid port of the bag container in correspondence of said first electro-actuated lock to engage and block into the same when the bag container is correctly coupled to the bag-holding frame, with a micro-switch provided within said first electro-actuated lock to detect the correct blocking of the rigid port in the bag-holding frame and to send a signal of correct blocking of the bag container on the bag-holding frame to a control unit, said first coupling and hooking electro-mechanical means further comprising a first electric connector provided on the bag-holding frame and a second electric connector provided on the rigid port of the bag container in correspondence of said first electric connector to realize the electric connection between the bag container, the bag-holding frame and the control unit when the bag container is positioned on the bag-holding frame, said first coupling and hooking electro-mechanical means further comprising a position sensor, provided on the bag-holding frame, to detect the presence of the bag container in the correct position on the bag-holding frame and to send a signal of the presence of the bag container on the bag-holding frame to the control unit; and said second coupling and hooking electro-mechanical means comprising a second lock provided on the rigid port of the bag container and a hooking element provided on the lid in correspondence of said second lock to engage and block into the same when the lid is correctly inserted on the rigid port in a closure position of the bag container, with a micro-switch provided within said second lock to detect the correct insertion of the lid in the rigid port of the bag container and to send to the control unit a signal of correct insertion of the lid through the electric connectors between the bag container and the bag-holding frame.

2. The system for the safe coupling of a re-usable bag to a banknote handling and storing machine according to claim 1, wherein said second lock further includes a release button configured to release the lid, after the bag container having been removed from the machine, for withdrawal of banknotes from the bag container by an operator.

3. The system for the safe coupling of a re-usable bag to a banknote handling and storing machine according to claim 2, wherein a door is provided on the rigid port of the bag container, in correspondence of the release button, to be movable between a closed position preventing the access to the release button and an open position, wherein it is possible reaching the release button.

4. The system for the safe coupling of a re-usable bag to a banknote handling and storing machine according to claim 3, wherein the door is pivotable about a horizontal axis to shift from a lowered condition, corresponding to the closed position, to a lifted condition, corresponding to the open position.

5. The system for the safe coupling of a re-usable bag to a banknote handling and storing machine according to claim 3, wherein the door and a fixed portion of the rigid port of the bag container are provided with respective slots suitable for the insertion of a safety seal to prevent the opening of the door.

6. The system for the safe coupling of a re-usable bag to a banknote handling and storing machine according to claim 1, wherein said first electro-actuated lock is provided on the rear portion of the bag-holding frame and is faced toward the front part thereof and in that the blocking element of the rigid port of the bag container is provided on the rear portion of said rigid port, projecting rearwardly therefrom.

7. The system for the safe coupling of a re-usable bag to a banknote handling and storing machine according to claim 1, wherein the first electric connector is provided on the rear portion of the bag-holding frame, faced toward the front part thereof, and in that the second electric connector is provided on the rear portion of the upper rigid port of the bag container.

8. The system for the safe coupling of a re-usable bag to a banknote handling and storing machine according to claim 1, wherein the position sensor is provided on the rear portion of the bag-holding frame, faced toward the front part thereof.

9. The system for the safe coupling of a re-usable bag to a banknote handling and storing machine according to claim 1, wherein said second lock is provided on the rear portion of the rigid port of the bag container and faced toward the front part thereof, and in that the hooking element of the lid is provided on the rear portion of the lid, projecting downwardly therefrom.

10. The system for the safe coupling of a re-usable bag to a banknote handling and storing machine according to claim 1, wherein said second lock is an electro-actuated lock.

11. The system for the safe coupling of a re-usable bag to a banknote handling and storing machine according to claim 1, wherein the closure lid of the bag container is provided with a radiofrequency identification device.

12. The system for the safe coupling of a re-usable bag to a banknote handling and storing machine according to claim 11, wherein the bag container is provided with a radiofrequency identification device.

13. A method for coupling and removal of a bag container from a banknote handling and storing machine according to the coupling system of claim 3, comprising, for the insertion of the bag container into the machine, the method includes the steps of:

applying a safety seal on the closure door of said second lock provided on the rigid port of the bag container, thus preventing the access to the lid release button;

introducing the bag container inside the machine, inserting its upper rigid port into guides of the bag-holding frame until engagement of the blocking element in said first electro-actuated lock provided on the bag-holding frame, thus realizing an electric connection between the electric connectors respectively provided on the bag-holding frame and on the bag container and sending to the control unit a signal of presence and correct blocking of the bag container on the bag-holding frame;

and for removal of the bag container from the machine, the method further includes the steps:

inserting the closure lid onto the upper rigid port of the bag container along guides of said rigid port until engagement of the hooking element in said second lock provided on the rigid port of the bag container, thus sending to the control unit a signal of correct insertion of the lid through the electric connectors between the bag container and the bag-holding frame and obtaining from the control unit an opening command for said first electro-actuated lock to release the bag container from the bag-holding frame; and extracting the bag container from the machine.

14. The method for coupling and removal of a bag container from a banknote handling and storing machine according to claim 13, wherein, after the extraction of the bag container from the machine and the transfer to destination, the safety seal is removed from the closure door of said second lock, the door is brought into the opening position and the release button is actuated to release the lid from the rigid port of the bag container.

15. The method for coupling and removal of a bag container from a banknote handling and storing machine according to claim 13, wherein the lid is provided with a radiofrequency identification device with a code associating it with a bag container and the bag container is provided in turn with an identification code, upon occurring the correct association between the codes of the lid and of the bag container the control unit enabling unlock of said first electro-actuated lock and, consequently, the extraction of the bag container from the machine.

* * * * *